United States Patent [19]

White, Jr.

[11] Patent Number: 4,859,160

[45] Date of Patent: Aug. 22, 1989

[54] CUTAWAY ROTOR GEROTOR DEVICE

[76] Inventor: Hollis N. White, Jr., 243 Pyle La., Hopkinsville, Ky. 42240

[21] Appl. No.: 98,362

[22] Filed: Sep. 18, 1987

[51] Int. Cl.[4] ..... F01C 1/10; F01C 21/08

[52] U.S. Cl. ..... 418/61.3

[58] Field of Search ..... 418/61 B; 73/256; 74/804, 805

[56] References Cited

U.S. PATENT DOCUMENTS

| | | | |
|---|---|---|---|
| 385,970 | 7/1888 | Tilden | 73/256 |
| 661,067 | 11/1900 | Nash | 418/61 B |
| 3,424,095 | 1/1969 | Hansen | 418/61 B |
| 3,723,032 | 3/1973 | Woodling | 418/61 B |
| 3,775,031 | 11/1973 | Hansen | 418/61 B |
| 3,876,343 | 4/1975 | Giversen | 418/61 B |

*Primary Examiner*—John J. Vrablik

*Attorney, Agent, or Firm*—Woodling, Krost & Rust

[57] ABSTRACT

An improved gerotor device is disclosed wherein the lobes of the rotor are cutaway to the main lines of action of the device.

14 Claims, 5 Drawing Sheets

CUTAWAY ROTOR GEROTOR DEVICE

FIELD OF THE INVENTION

This invention relates to an improved gerotor device.

BACKGROUND OF THE INVENTION

Gerotor hydraulic devices are an excellent means of transferring large amounts of torque into remote locations. The torque is generated by capturing the high pressure of a fluid within expanding gerotor cells. In a typical gerotor motor, such as that disclosed in Mr. White's U.S. Pat. No. 4,357,133, the gerotor cells are defined by the contact between the lobes of an rotor and the rolls of a surrounding stator —the shape of the lobes of the rotor and rolls of the stator normally producing a constant contact between all of the lobes of the rotor and the rolls of the stator. This contact divides the pressure arc between the rotor and stator into a series of multiple gerotor cells. Each individual gerotor cell of this type of device is therefor normally of limited volume. The limited size of each of these cells, along with the multiplicity needed to produce the desired physical capacity for the gerotor device, is accepted by the industry as an inherent limitation to the devices. This is true even though the limitation includes increased wear, increased heat and other attendant difficulties. The present invention is directed towards producing a gerotor device with an increased volume gerotor cell.

SUMMARY OF THE INVENTION

The present invention is directed towards increasing the size of cells in a gerotor device.

It is an object of this invention to reduce the wear in gerotor devices.

It is an object of the invention to increase the service life of gerotor devices and It is an object of this invention to improve the operating characteristics of gerotor devices.

DESCRIPTION OF THE PREFERRED EMBODIMENT

Figure 1:
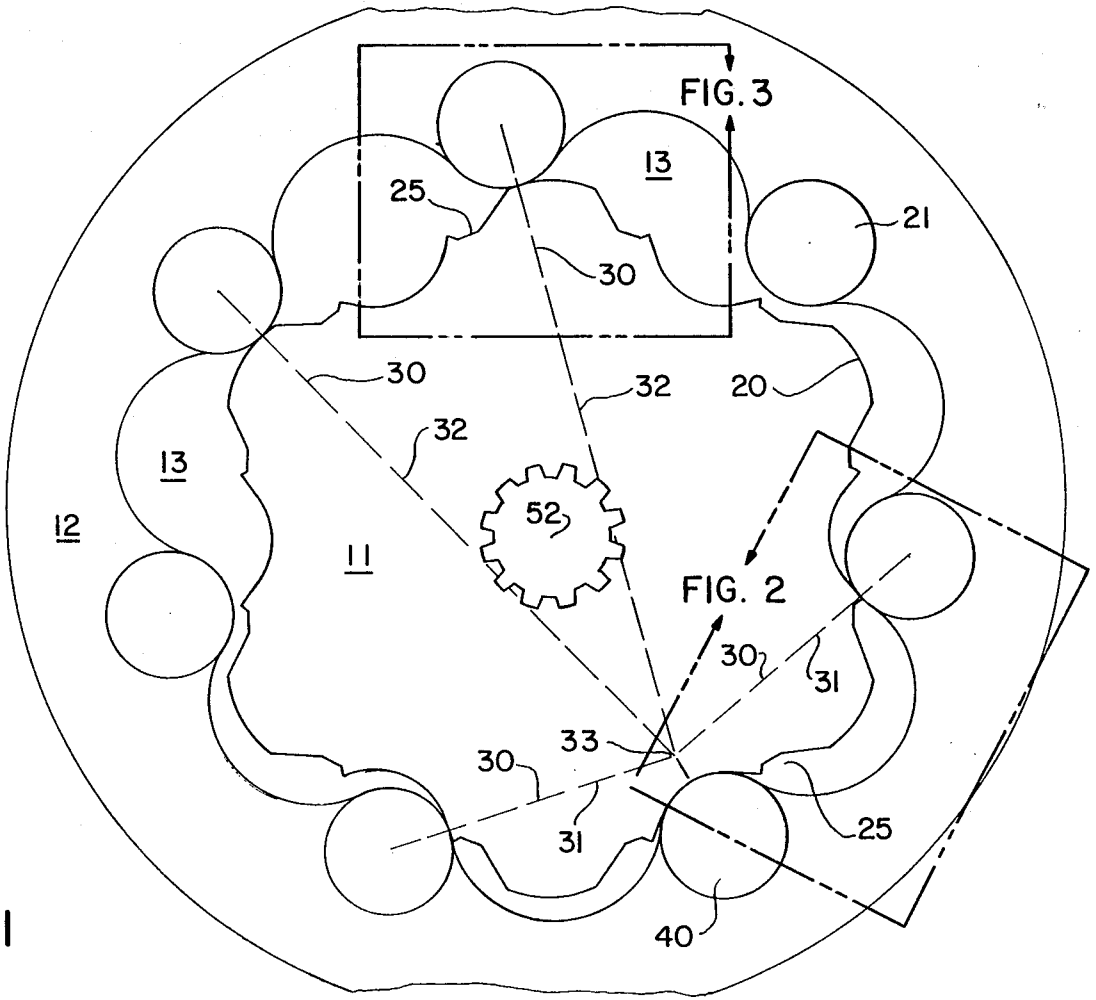
FIG. 1 is a central lateral cross-sectional view of a gerotor device incorporating the invention including a stator and cutaway rotor.

This invention relates to an improved gerotor device. Gerotor devices 10 incorporate a rotor 11 and stator 12 defining pressure cells 13 therebetween. The rotor 11 is located slightly off-center within the stator 12 for orbital motion therein. The rotor 11 shown has an outer surface that, except for the cutaways later defined, has a generated shape. As the rotor 11 rotates within the stator 12, the lobes 20 of the rotor 11 variably contact the rolls 21 of the stator 12. The locus of contact points as these elements mesh define lines of action 30. Normally these lines of action 30 continually vary in respect to a particular lobe 20, swinging in an arc of perhaps 120 degrees through one revolution about the stator: the lobes 20 of the rotor 11 are in contact with a roll 21 of the stator 12 continually throughout such revolution. In the embodiment shown the lines of action 30 meet at a point 33 locaetd a distance susbstantially equal to six times the offset of the axis of the rotor from the axis of the stator (six being the number of rotor lobes) off the center axis 52 of the rotor.

Figure 2:
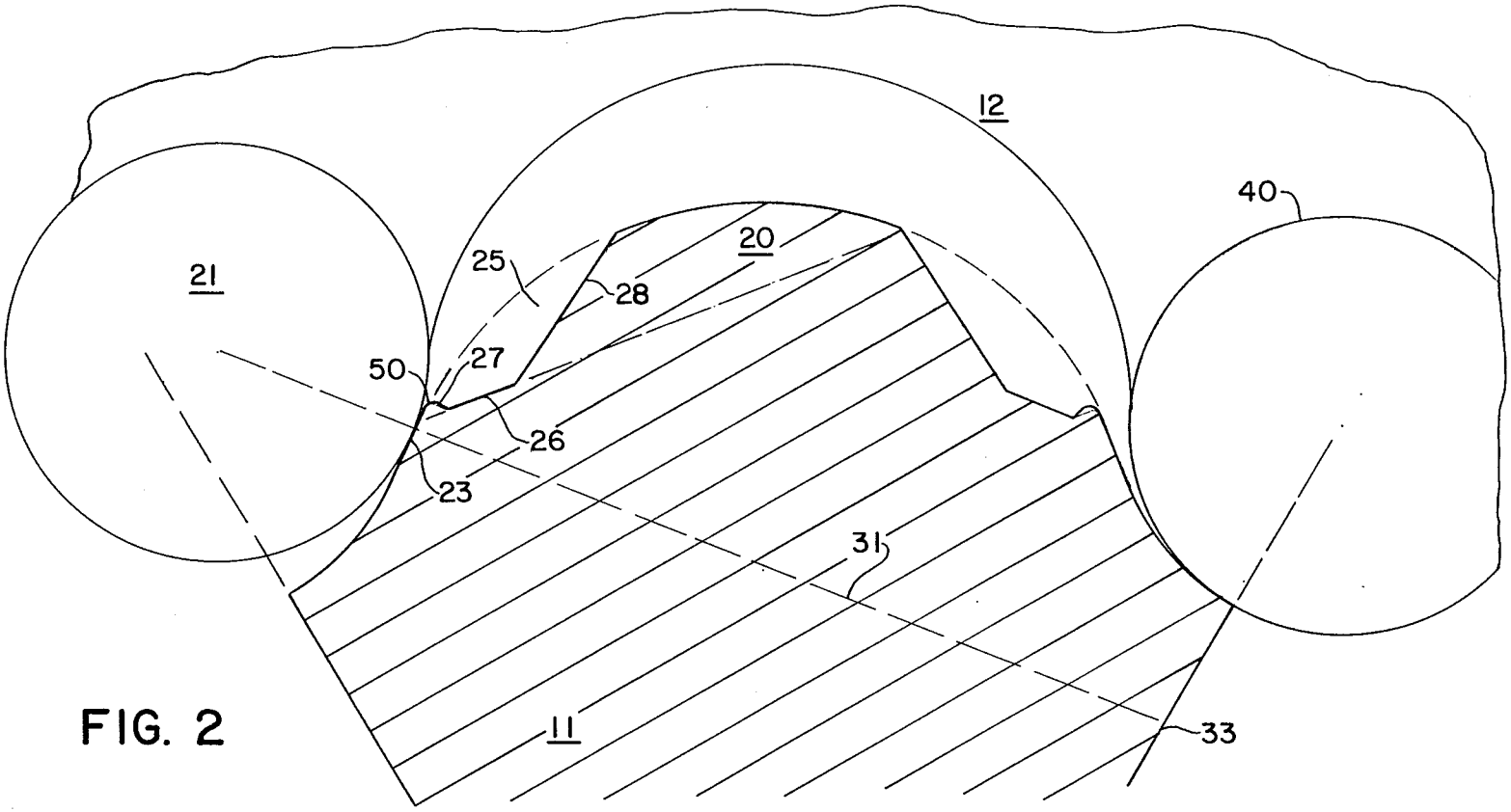
FIG. 2 is an enlarged sectional view of a cutaway lobe of the rotor of FIG. 1 with a stator roll defining one edge of the cutaway.
Figure 3:
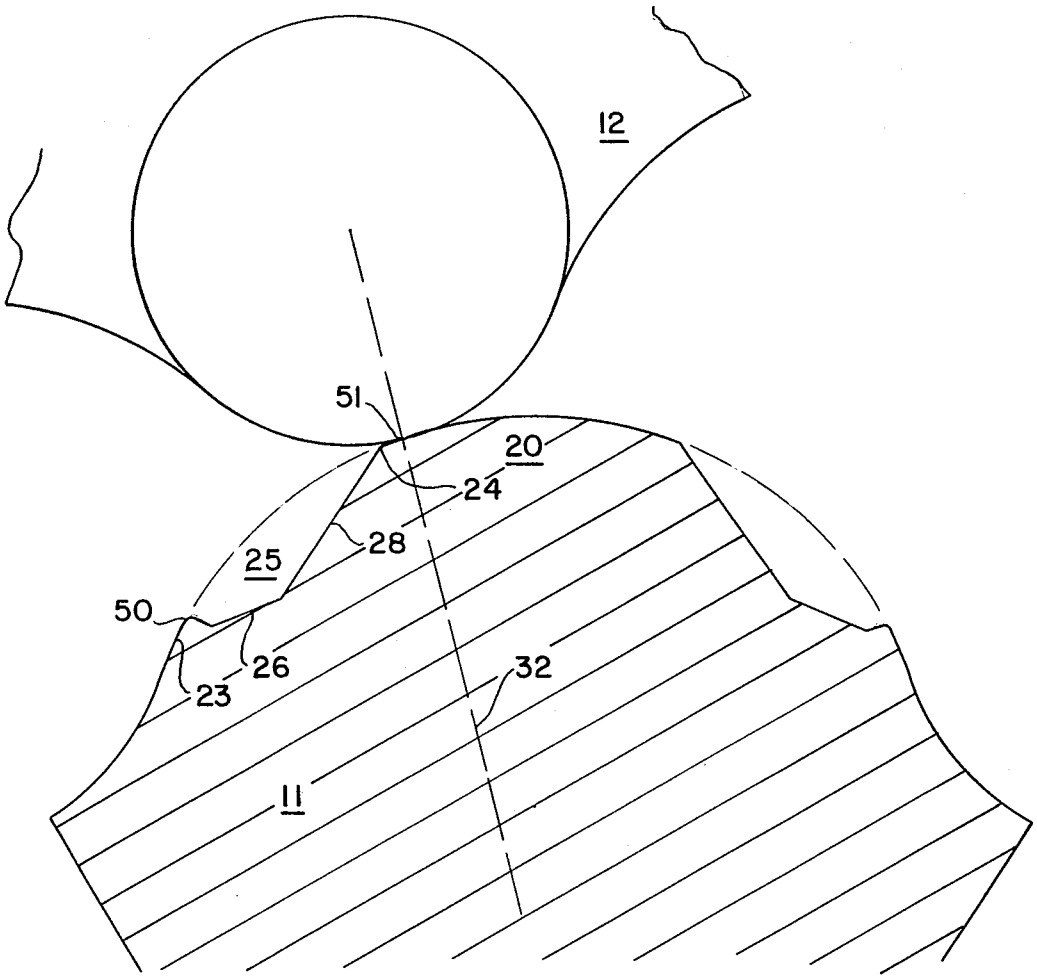
FIG. 3 is an enlarged sectional view of a cutaway lobe of the rotor of FIG. 1 with a stator roll defining the other edge of the cutaway.

In the invention of this application, the lobes 20 of the rotor 11 are cut away 25 to the main lines of action 31, 32 through such lobe 20 (FIGS. 2, 3). The main lines of action 31 are the lines through the locus points of mesh of the two lobes closest to the top dead center stator roll and the main lines of action 32 are the lines through the locus points of mesh of the two lobes opposite the top dead center lobe. These lines together define the limits of the expanding and contracting gerotor cells.

The main line of action 31 in the preferred embodiment shown is the line of action for the stator roll neighboring the top dead center 40 stator roll 21. This line of action 31 intersects type outer surface of the rotor lobe 20 at the defined point 23 of the leading edge of the cutaway 25. In this embodiment the edge 26 of the cutaway 25 from the defined point 23 extends at an angle of substantially 45 degrees in respect to the line of action with a reinforcing section 27 extending slightly into the cutaway. The 45 degree angle spreads the compression load from the point of contact at the critical line of action over an expanded area and in a diffuse manner than would otherwise occur. This also serves to compress the outer layer of the case hardened rotor into the lower carbon steel inner core of the rotor, thus improving the longevity of the device. In the preferred embodiment shown a reinforcing section 27 aids this transfer and in addition insures a good seal at this point by carrying the shape of the lobe 20 slighly beyond the critical line of action (technically the cutaway 25 could extend all the way to the line of action 31 and to the defined point 23). This cutaway edge 26 provides a blending between adjacent gerotor cells 13 on either side of a top dead center stator roll 21 (valley contact).

The main line of action 32 in the preferred embodiment shown is the line of action between stator rolls 21 through rotor 11 and point 33. This line of action 32 intersects the outer surface of the rotor lobe 20 at the defined point 24 of the trailing edge of the cutaway. The defined edge 28 of the cutaway 25 from the defined point 24 extends at again substantially a 45 degree angle to the neighboring line of action. This cutaway edge 28 provides a blending between adjacent gerotor cells 13 on either side of a stator roll 21 in contact with the center of a lobe 20 of the rotor 11 (lobe contact).

To insure contact between the rotor and stator at the other points and to spread the load therebetween it is preferred that the lobes be left unchanged in profile for a short distance (typically 0.010 to 0.080 inches) past the defining line of actions. This continuation in profile is shown at 50 in FIG. 2 and 51 in FIG. 3 respectively.

Figure 4:
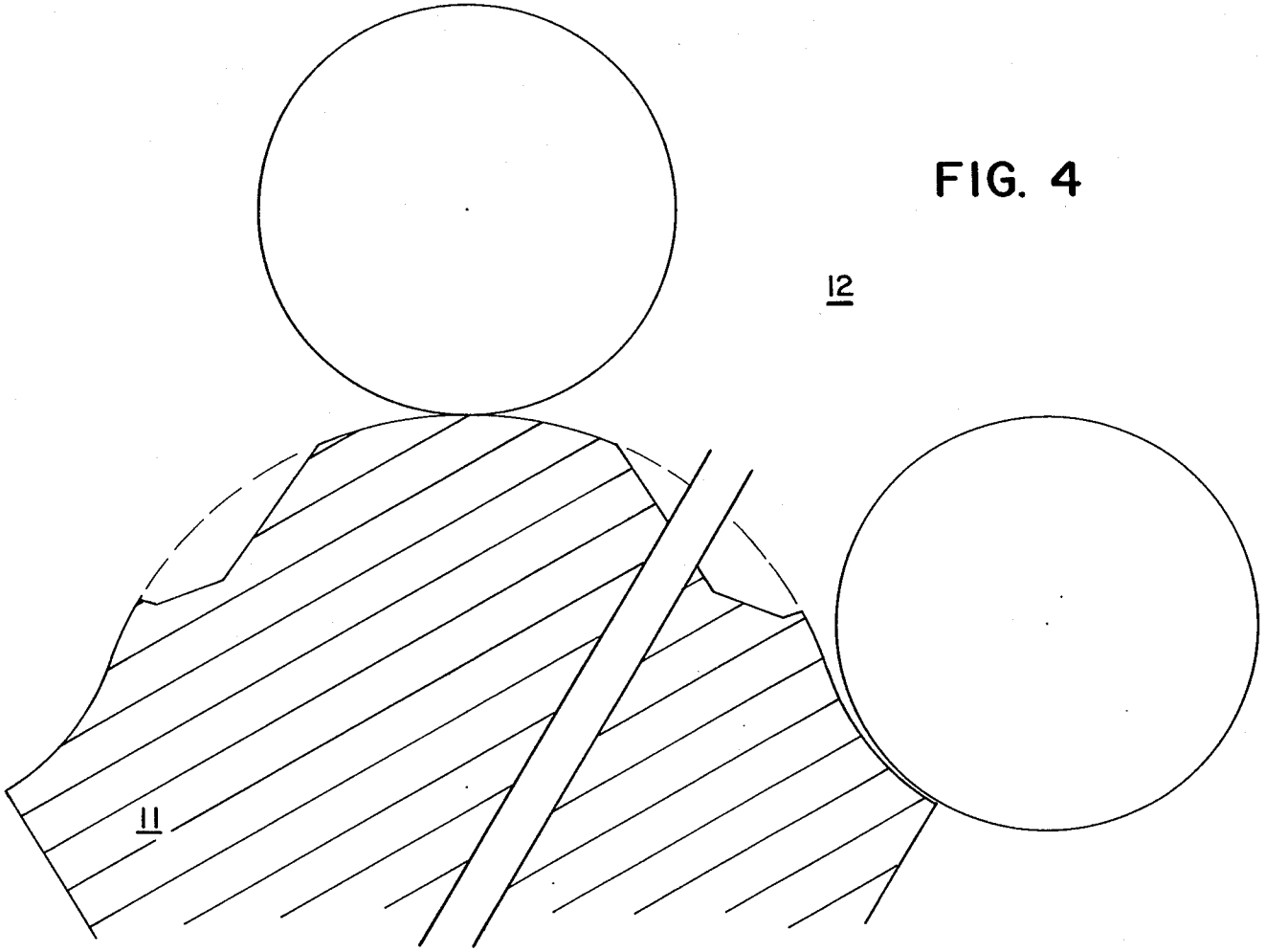
FIG. 4 is an enlarged sectional view of the cutaway lobe of a rotor like FIG. 1 showing the relationship of the rotor to intermediate stator rolls.

The cutaway 25 effectively expands the size of the gerotor cells 13 by creating blend points between the active expanding and contracting gerotor cells 13. The blend points allow fluid to flow between neighboring gerotor cells. Due to this blending a series of gerotor cells (either expanding or contracting) are connected as a unit to a series of manifold openings (and through such manifold openings to an appropriate port). This allows fluid to pass through the path of least resistance between the cells and the appropriate port. This effectively enlarges the manifold opening for the cell that has an intake or discharge of the most fluid and, as such, reduces a flow impediment that would otherwise exist. For example the movement of the rotor from the cell at 1 o'clock in FIG. 1 to the cell at 2 o'clock in FIG. 1 will displace more fluid than movement of the rotor from the cell at 2 o'clock to the cell at 4 o'clock. By interconnecting the cells at 1, 2 and 4 o'clock the fluid of all three cells can as a unit move to (or from) a port through all three manifold openings. This allows the fluid to equalize itself over more than one manifold opening, increasing the fluid transfer efficiency for the device over a conventional closed gerotor cell single manifold opening per cell device. The cutaways shown also reduce the internal friction of the device by eliminating the sealing contact between rotor and stator atthe location of the cutaways (for example, at 1 and 9 o'clock in FIG. 1). As there still is a rotor to stator sealing contact separating these expanding and contracting cells 13 (i.e. between such cells), the overall operating efficiency of the device is not compromised-.Indeed quite the opposite. The location of the blend points causes the device to operate more in line with an ideal single expanding cell single contracting cell unit than as a multi-cell unit. The overall fluid path through the device is therefor improved by 10% or more due to the removal of flow restrictions. As seen in FIG. 4 the top dead center roll and bottom dead center roll are in sealing contact with the rotor 11. (These rolls are normally on opposite sides of the rotor. They are shown next to each other in order to reduce the size of the drawing).

Figure 5:
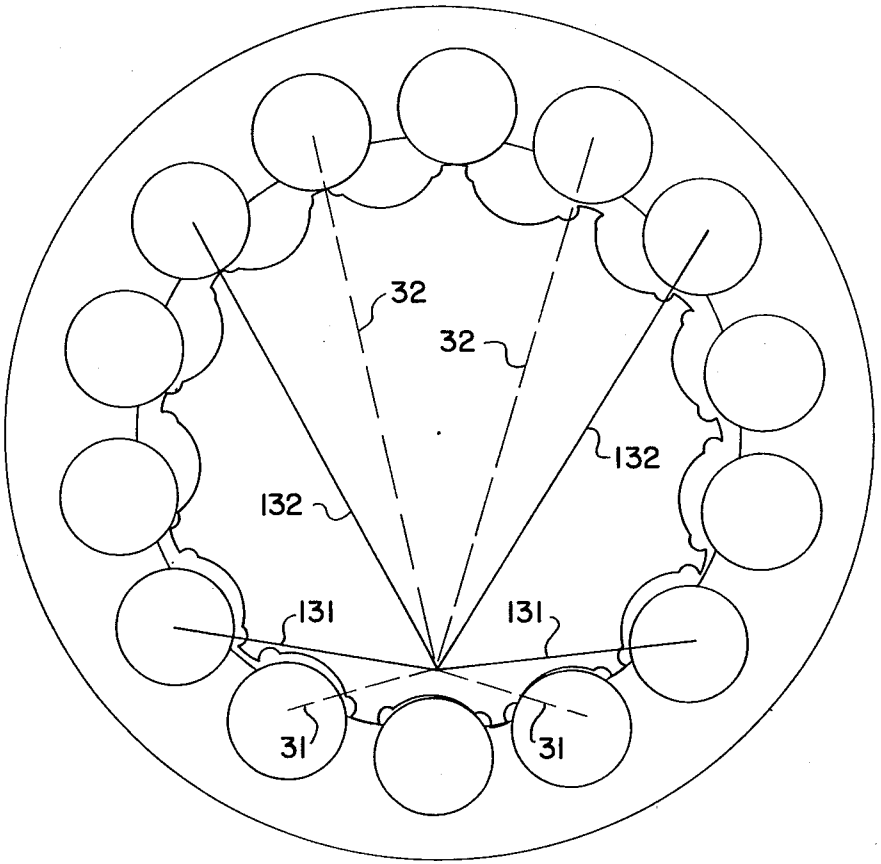
FIG. 5 is a central cross-sectional view of a thirteen lobed gerotor structure incorporating the invention.

Although this invention has been described in its preferred form with a certain degree of partcularity, it is to be understood that numerous changes may be made without deviating from the invention. For example, the preferred embodiment disclosed is a six lobed rotor within a seven roll stator. The invention could be equally well utilized with other differently configured gerotor cell mechanisms—such as a 13 lobed rotor within a fourteen roll stator. With this odd numbered lobe rotor, the main line of action 31 is through the points of mesh of the lobes bridging the top dead center stator roll and the main line of action 32 is through the points of mesh of the lobes neighboring the lobe directly opposite the bottom dead center gerotor cell. The invention could also be implemented more conservatively—such as using for our example 13 lobed rotor the lines of action (in FIG. 5) through the points of mesh of the lobes one away from the lobes bridging the top dead center stator roll for line 32 and the lines of action 131 (in FIG. 5) one away from the lobe directly opposite the bottom dead center gerotor cell for line 31. This more conservative design could also be produced by continuing the generated shape of the cutaway of the lobes for a distance beyond that technically necessary (and then perhaps in a rounded curved shape).

What is claimed is:

1. In a gerotor device having a rotor with a depth and generated lobe shape and with main lines of action to surrounding stator rolls, the main lines of action defining the edges between expanding and contracting sections of gerotor cells, the improvement of the lobes of the rotor being cut away between the main lines of action for the full depth of the rotor.

2. The gerotor device of claim 1 characterized in that the lobes have twoflanks with a cutaway in each, and the far edges of the cutaway in each flank being angled at substantially 45 degrees in respect to the main line of action running through such lobe.

3. The gerotor device of claim 2 wherein the rotor has an even number of lobes.

4. In a gerotor device having a rotor with a depth and a series of generated, generally semi-circular outwardly extending lobes with two flanks and with main lines of action to a surrounding stator roll of a generated stator, the main lines of action between the rotor and stator defining the leading and trailing edge of expanding and contracting gerotor cells therebetween, the improvement of the flanks of the lobes of the rotor being cutaway between the lines of action for the full depth of the rotor, cutaways creating blend points between gerotor cells surrounding a top dead center stator roll and between gerotor cells opposing a botton dead center rotor lobe.

5. The gerotor device of claim 4 wherein the rotor has an even number of lobes.

6. In a gerotor device having a stator with stator rolls and a rotor with a series of generated, generally semi-circular outwardly extending lobes with main lines of action through the the lobes when in contact with a stator roll, the main lines of action defining the edges between expanding and contracting sections of gerotor cells, the improvement of the lobes of the rotor being cut away between a location a short distance from each main lines of action such that there is a cutaway located between said main lines of action with reinforcing sections in the lobes extending from the main lines of action into said cutaway.

7. The gerotor device of claim 6 characterized in that said short distance is substantially 0.010 to 0.080 inches.

8. The gerotor device of claim 6 characterized in that the stator has a generated shape.

9. The gerotor device of claim 6 characterized in that the lobes have two flanks with a cutaway in each, and the far edges of the cutaway in each flank being angled at substantially 45 degrees in respect to the main line of action running through the lobe.

10. The gerotor device of claim 9 characterized in that said reinforcing section has a rounded tip adjacent to said cutaway flank.

11. In a gerotor device having a stator with stator rolls and a rotor with a series of generated, generally semi-circular outwardly extending lobes each with a first main line of action for stator rolls neighboring the rotor and a second main line of action from the stator roll neighboring the top dead center stator roll, the main lines of action defining the edges between expanding and contracting sections of gerotor cells, the improvement comprising the lobes of the rotor having a cutaway located between the main lines of action, each said cutaway having first and second edges, said first edge of each said cutaway beginning a short distance from the first main line of action between adjacent first and second main lines of action extending at an angle in respect to the first main line of action, said short distance for said first edge creating a first reinforcing section, said second edge of each said cutaway extending at an angle in respect to the second main line of action beginning a short distance from the second main line of action between adjacent first and second main lines of action, said short distance for said second edge creating a second reinforcing section and said second reinforcing section having a rounded tip adjacent to said second edge.

12. The gerotor device of claim 11 characterized in that said angle of said first and said second edge is substantially 45 degrees.

13. The gerotor device of claim 11 characterized in that said short distance from said first and second main lines of action is substantially 0.010 to 0.080 inches.

14. The gerotor device of claim 11 characterized in that said rounded tip of said reinforcing section extends beyond said second edge into said cutaway.

* * * * *